United States Patent [19]

Sheridan

[11] Patent Number: 4,522,446

[45] Date of Patent: Jun. 11, 1985

[54] ARTICLE OF FURNITURE

[75] Inventor: Denise Sheridan, Bankstown, Australia

[73] Assignee: Sebel Operations Pty. Ltd., Bankstown, Australia

[21] Appl. No.: 472,346

[22] Filed: Mar. 4, 1983

[30] Foreign Application Priority Data

Mar. 15, 1982 [AU] Australia ..... PF3096

[51] Int. Cl.[3] ..... A47C 1/024

[52] U.S. Cl. ..... 297/377; 16/272; 16/355; 297/22; 297/28; 297/DIG. 2

[58] Field of Search ..... 297/377, 21, 22, 27, 297/28, 239, DIG. 2; 16/355, DIG. 24, 262, 271, 272

[56] References Cited

U.S. PATENT DOCUMENTS

| | | | |
|---|---|---|---|
| 1,030,801 | 6/1912 | Berault | 16/262 |
| 2,696,869 | 12/1954 | Schlaak | 297/22 |
| 3,132,899 | 5/1964 | Render | 297/DIG. 2 |
| 3,259,432 | 7/1966 | Jackson | 297/DIG. 4 |

FOREIGN PATENT DOCUMENTS

| | | | |
|---|---|---|---|
| 138525 | 8/1950 | Australia | 297/22 |
| 814269 | 6/1969 | Canada | 16/355 |
| 1430011 | 1/1966 | France | 16/355 |
| 2285259 | 4/1976 | France | 297/DIG. 2 |
| 356273 | of 1938 | Italy | 297/22 |
| 309475 | 3/1969 | Sweden | 297/239 |
| 309137 | 11/1955 | Switzerland | 297/239 |
| 2714 | of 1905 | United Kingdom | 16/262 |
| 13517 | of 1909 | United Kingdom | 297/28 |

*Primary Examiner*—William E. Lyddane
*Assistant Examiner*—Peter R. Brown
*Attorney, Agent, or Firm*—Townsend and Townsend

[57] ABSTRACT

The present invention relates to a reclining chair or lounge having a pivotally connected back portion. The preferred form is a molded plastic sun lounge which can recline to function as a couch or bed. The sun lounge is able to be stacked when in the fully reclined position, and has arm rests which are adjusted in attitude according to the position of the back rest so as to maintain comfortable arm support throughout all back rest positions.

12 Claims, 12 Drawing Figures

FIG. 11
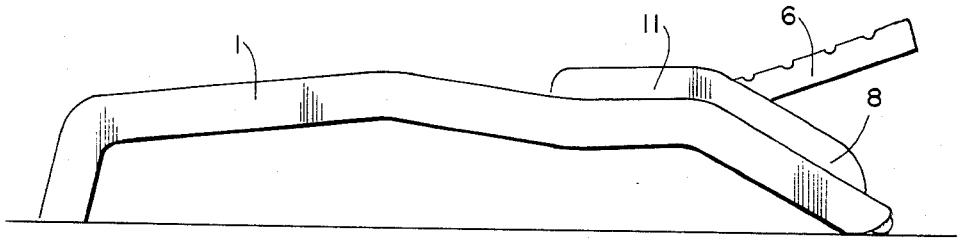
FIG. 10
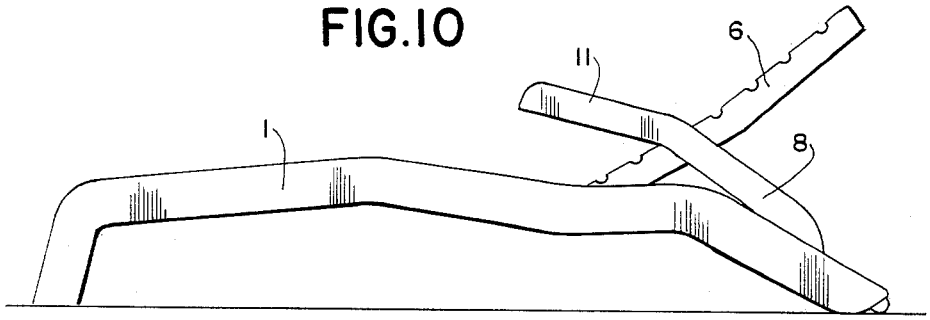
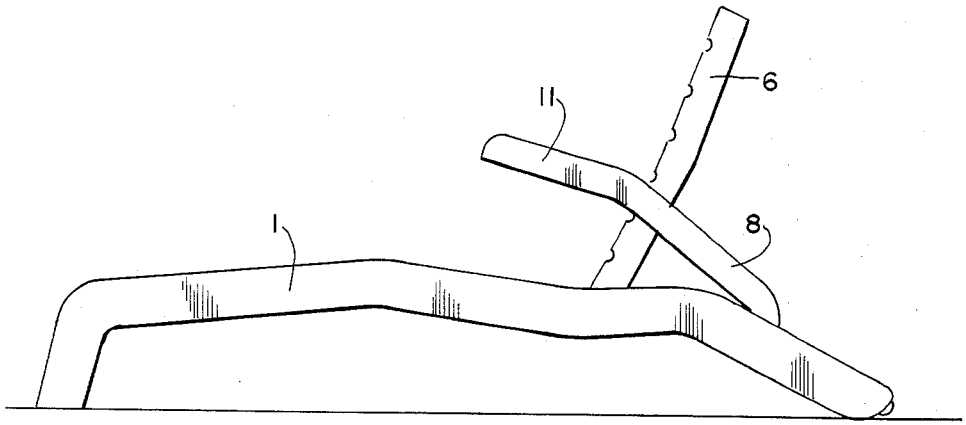
FIG. 9

ARTICLE OF FURNITURE

The present invention relates to reclining chairs having two arm rests, a seat and a back rest which is adjustable relative to the seat so as to alter the angle of inclination of the back rest. Accordingly, the present invention is applicable to sun lounges of the type found alongside swimming pools and on which people recline at full length. The present invention is also applicable to chairs of more conventional construction such as arm chairs.

Several difficulties arise in relation to such reclining chairs in as much as it is often difficult to manipulate the mechanism which alters the degree of inclination of the back rest, especially whilst the sitter remains seated. In addition, there is generally no provision made for altering the attitude of the arm rests so that a convenient and comfortable attitude for the arm rests is not maintained for all positions of the back rest.

It is an object of the present invention to overcome, or substantially ameliorate, the abovementioned disadvantages.

According to one aspect of the present invention there is disclosed a reclining chair comprising a generally horizontal seat portion, rear legs, front legs, and a back portion pivotally connected at its lower end to said seat portion and movable between an upright and at least one inclined positions, wherein strut means are pivotally connected to said back portion at a location spaced from the pivotal connection between said back and seat portions, and interconnect said rear legs and said back portion; the point of contact of said strut means with said rear legs being adjustable to determine the degree of inclination of said back portion; and said strut means extending forwardly past said back portion to form arm rest means having an attitude adjustable simultaneously with the inclination of said back portion.

Preferably the reclining chair comprises a sun lounge which is able to have its back portion inclined into a substantially horizontal position and which is able to be moulded from plastics material such as polypropylene. In addition, the sun lounge is preferably moulded into four individual pieces permitting it to be transported in a knockdown condition. Finally, the sun lounge is preferably stackable with the back portion in its lower most, substantially horizontal, position thereby permitting a number of sun lounges to be stored in a limited volume during periods of inclement weather, for example.

One embodiment of the present invention will now be described with reference to the drawings in which:

FIG. 9 is a side elevation of the sun lounge of the preferred embodiment with the back portion in an elevated position;

FIG. 10 is a view similar to FIG. 7 with the back rest in a more inclined position;

FIG. 11 is a view similar to FIG. 7 with the back portion in the lower most position.

Figure 1:
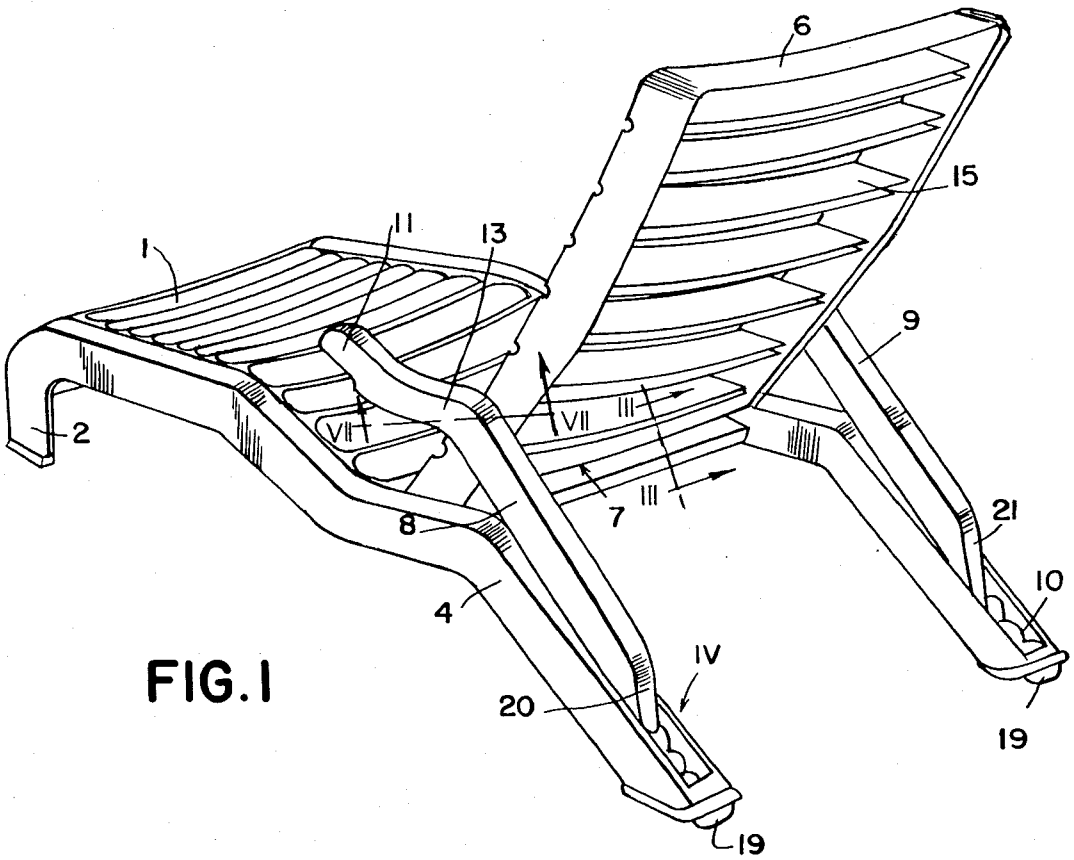
FIG. 1 is a rear perspective view of the sun lounge of the preferred embodiment.
Figure 2:
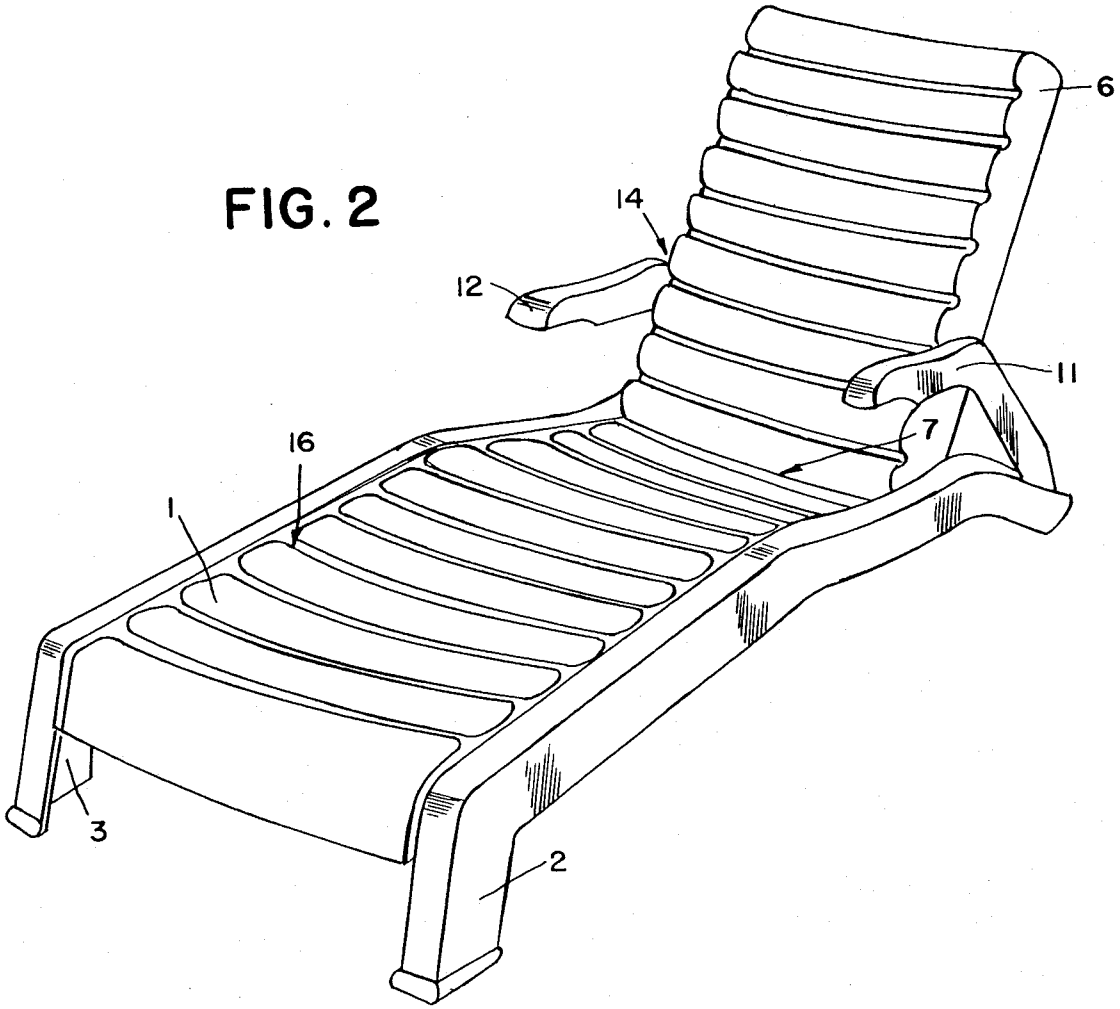
FIG. 2 is front perspective view of the sun lounge of FIG. 1.

As seen in FIGS. 1 and 2, the sun lounge of the preferred embodiment comprises a seat portion 1 which is of a sufficient horizontal extent to support the legs of a person sitting or lying on the sun lounge. The seat portion 1 is supported by two front legs 2, 3 and two rear legs 4, 5. It will be seen that the seat portion 1 is not flat but rather curved as appropriate to support the hips, thighs and calves of a person sitting on the sun lounge.

The sun lounge is provided with a back rest 6 which is pivotally connected at 7 to the seat portion 1. The back rest 6 is supported by two struts 8 and 9 which at their lower ends are engaged in corresponding ones of a plurality of grooved steps 10. The upper ends of the struts 8, 9 are shaped to form arm rests 11, 12 respectively.

The seat portion and legs are preferably moulded from plastics material (such as polypropylene) in a single piece whilst the back rest 6 and struts 8, 9 are similarly preferably moulded from plastics material, each in a separate piece. Thus the sun lounge is able to be formed from four moulded pieces which can be transported in a knockdown condition and assembled after transportion.

Figure 3:
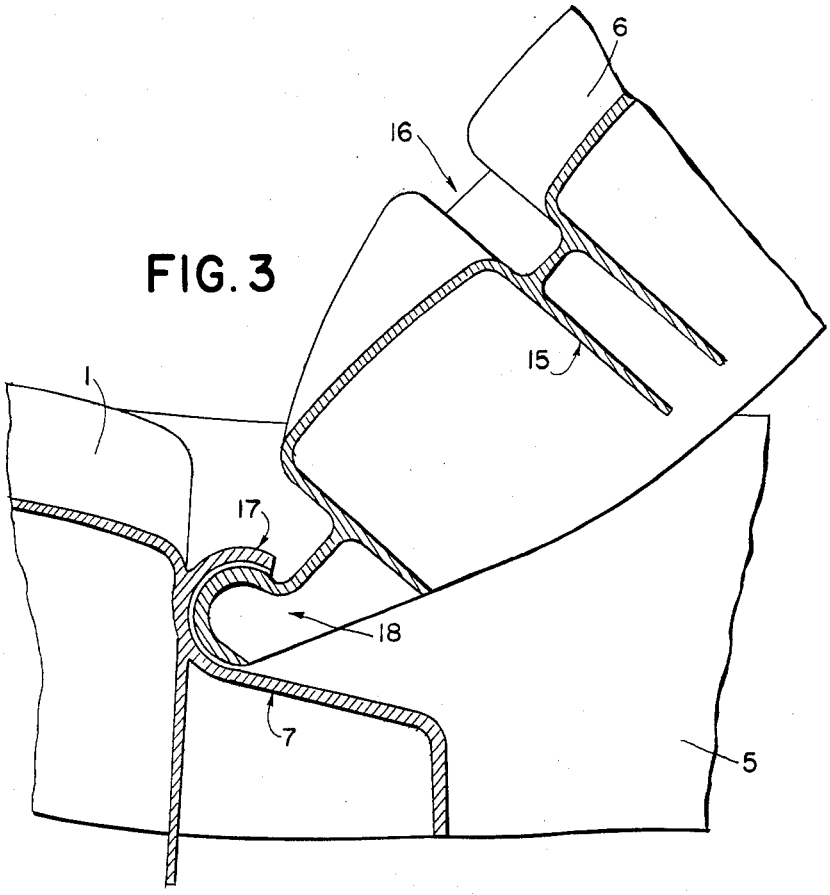
FIG. 3 is a cross-sectional view taken along the line III—III of FIG. 1.

As seen in FIG. 3, the back seat 6 is hinged to the seat portion 1 by means of a part-cylindrical though 17 which extends along the line of pivot 7 and which receives in a snap-in and rotatable engagement, a protrusion 18. The protrusion 18 extends along the lower edge of the back rest 6 and has a partially circular transverse cross-section with an external diameter approximately equal to that of the internal diameter of the trough 17 on the seat portion 1. By such means, the back rest 6 is able to be quickly and easily snapped into the seat portion 1 and pivoted in relation thereto.

Figure 8:
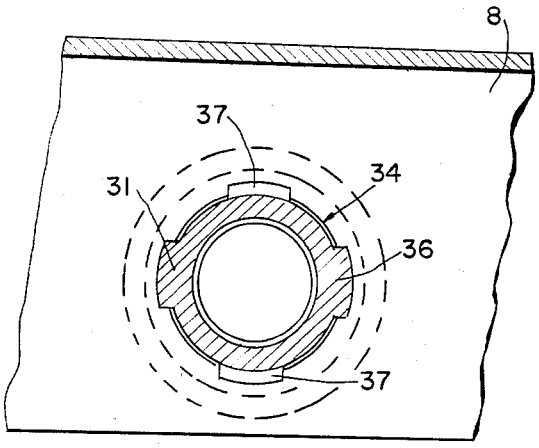
FIG. 8 is a cross-sectional view along the line VIII—VIII of FIG. 7.
Figure 7:
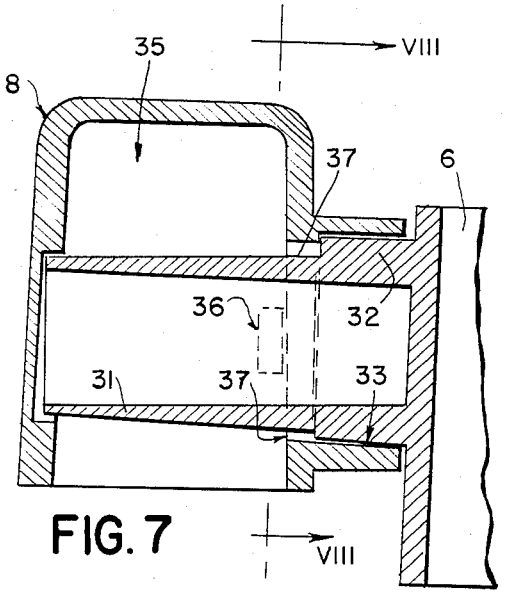
FIG. 7 is a cross-sectional view along the line VII—VII of FIG. 1.

Similarly, the struts 8, 9 are pivotally connected to the back rest 6 at locations 13 and 14 respectively. The detail of the pivotal engagement between the struts 8, 9 and back rest 6 is illustrated in FIGS. 7 and 8. The pivotal engagement is the same for both struts 8 and 9 although only the arrangement for strut 8 is illustrated.

As seen in FIG. 7, at the side 30 of the back rest 6 a generally cylindrical pin 31 is provided. The pin 31 has a cylindrical shoulder 32 which is received within a circular recess 33, the arrangement being such that shoulder 32 and recess 33 form a bearing. The pin 31 itself passes through a circular aperture 34 into the interior 35 of strut 8. As seen in FIG. 8, the pin 31 is provided with two generally rectangular bosses 36 located just inside the interior 35 and opposed to each other. The aperture 34 is also provided with two opposed grooves 37 which are of slightly larger than, but generally similar dimensions to, those of the bosses 36.

It will be apparent that with the strut 8 and the back rest 6 correctly aligned, the pin 31 can be passed into (or withdrawn from) the interior 35. Thereafter as the back rest 6 and strut 8 move relative to each other, the shoulder 32 is maintained engaged with recess 33 since the bosses 36 engage the inner surface of the strut 8 adjacent to the aperture 34. In this way a secure, pivotable arrangement is achieved which is releasable by the use of manual tools (not illustrated).

Figure 6:
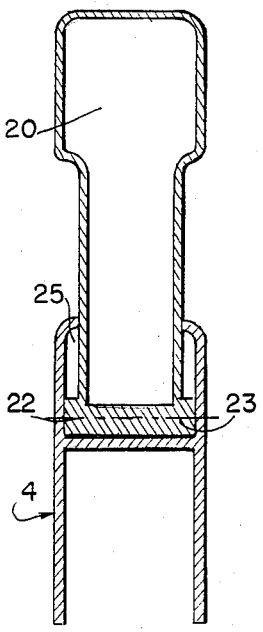
FIG. 6 is a cross-sectional view along the line VI—VI of FIG. 5.
Figure 4:
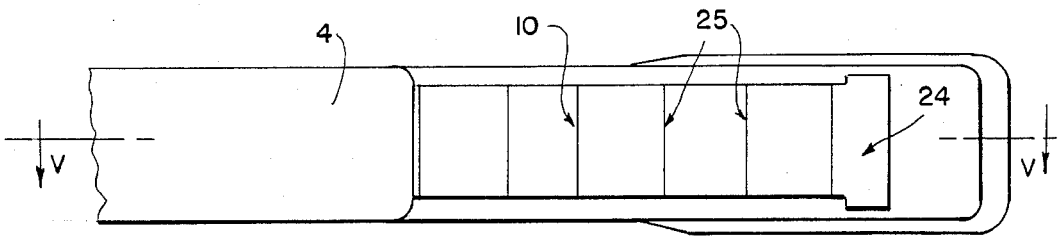
FIG. 4 is a plan view in the direction of arrow IV of FIG. 1.
Figure 5:
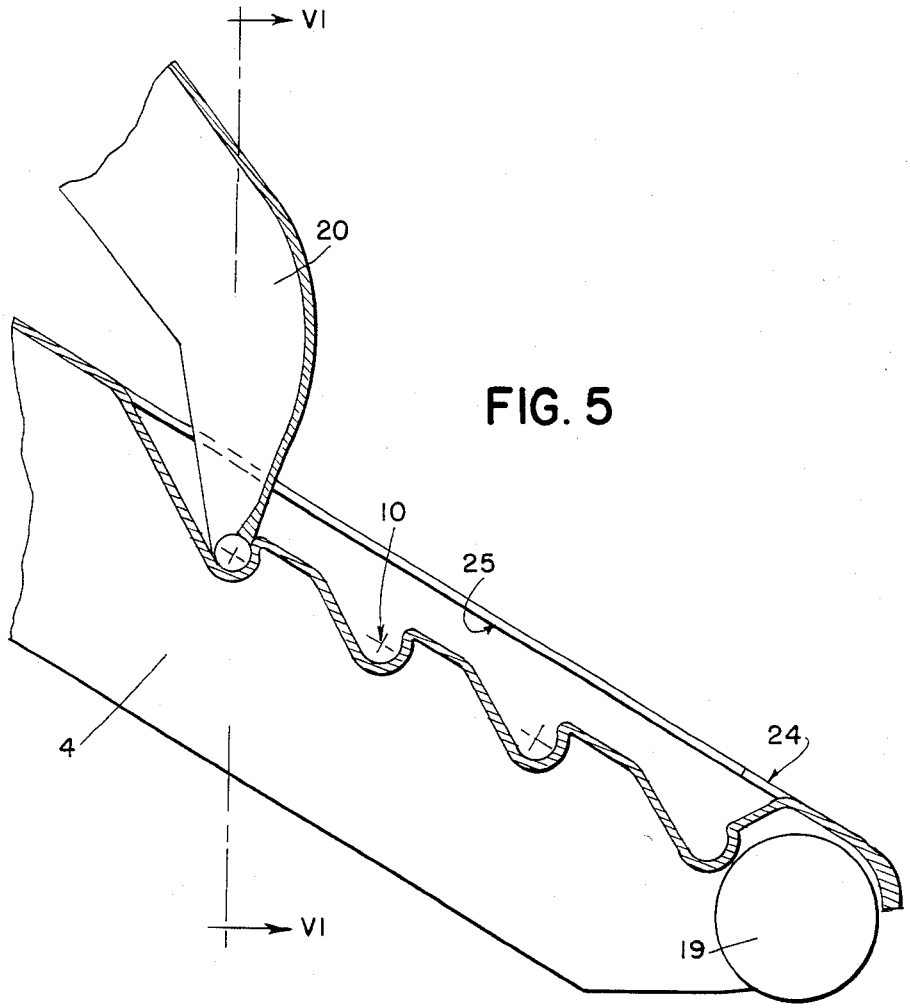
FIG. 5 is a cross-sectional view along the line V—V of FIG. 4.

As seen in FIGS. 4 to 6 each of the lower ends 20, 21 of the struts 8, 9 are provided with two horizontally extending lugs 22 and 23. The lugs 22, 23 are able to pass through a transverse slot 24 in order to locate the end 20 of strut 8, as seen in FIG. 6, within a longitudinal slot 25 located in each of the rear legs 4, 5.

The longitudinal slot 25 has a width slightly less than the length of transverse slot 24, so that once the end 20 has been engaged with longitudinal slot 25 and moved away from transverse slot 24, the lugs 22, 23 retain the end 20 of strut 8 within the longitudinal slot 25. This applies whether end 20 is engaged in one of the grooved steps 10 or is moving between the grooved steps 10.

It will be apparent from FIG. 1 and FIGS. 9 to 11 that the angle of inclination of the back rest 6 can be adjusted by determining which pair of grooves 10 are engaged by the lower ends 20, 21 of the struts 8, 9. As seen in FIGS. 9 and 10 in particular, the angle of inclination of the back rest 6 can be easily adjusted by this means between a substantially upright position and a plurality of more and more inclined positions. In the position illustrated in FIG. 5, the lower ends of the struts 8, 9 are engaged with the lowermost grooves 10 thereby lowering the back rest 6 to a substantially horizontal rest position at which the sun lounge can be used as a bed.

Figure 12:
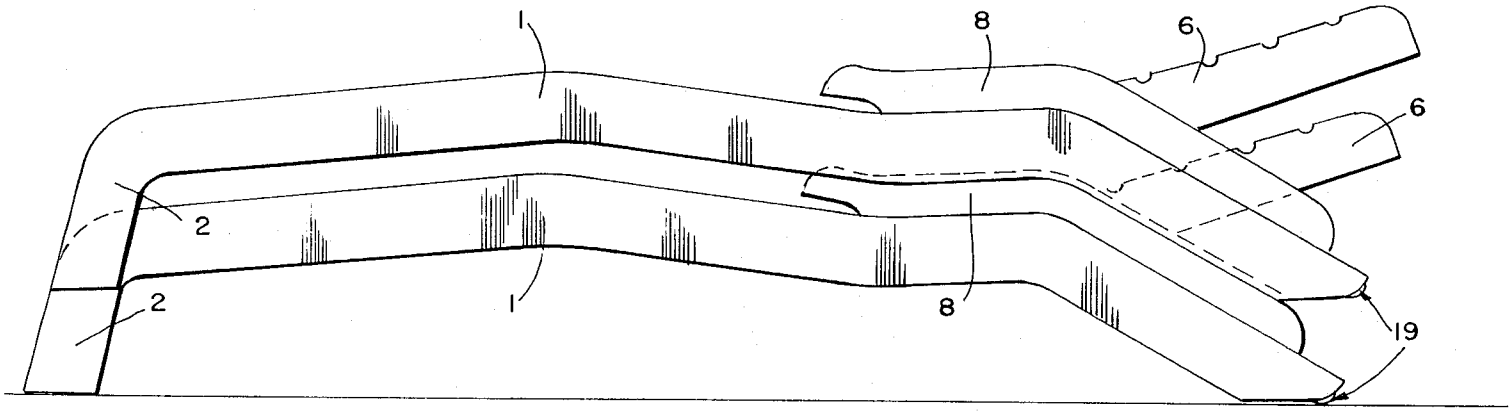
FIG. 12 is a side elevation of two sun lounges in the configuration illustrated in FIG. 9 stacked one above the other.

As further illustrated in FIG. 12, with the sun lounge in the configuration illustrated in FIG. 11, a plurality of the sun lounges can be stacked one above the other thereby resulting in a substantial saving in storage volume required when such sun lounges are not needed, due to inclement weather for example. It will be apparent from FIGS. 1, 2 and 12 that the relatively thin wall section of the legs accommodates the front legs 2, 3 and the upper portion of the struts 8, 9 when two or more of the sun lounges are stacked one above the other.

It will also be apparent from FIG. 1 that a major advantage of the sun lounge of the preferred embodiment is that the arm rests 11, 12 can be manipulated whilst a person is sitting in the sun lounge in order to release the struts 8, 9 from one pair of grooves 10 and engage another pair of grooves 10 so as to alter the degree of inclination of the back rest 6. In particular, the lugs 22, 23 (FIG. 6) prevent disengagement of the struts 8, 9 with the rear legs 4, 5 during this procedure. In this way, the tiresome requirement of prior art sun lounges for the sitter to stand up in order for the back rest inclination to be adjusted, is avoided.

Furthermore, as seen in FIGS. 9 and 10, as the inclination of the back rest 6 varies so does the attitude of the arm rests 11, 12, this adjustment being both simultaneous and automatic. In particular, as the degree of inclination of the back rest 6 changes, in order for the person sitting, or reclining, in the sun lounge to adopt a comfortable position of the arms it is necessary that the attitude of the arm rests change. This necessary adjustment is catered for by the above described arrangement.

It will be apparent from FIGS. 1 and 2, in particular, that the sun lounge of the preferred embodiment is moulded so as to provide a series of transverse ribs 15 which serve to strengthen the seat portion 1 and back rest 6 and also provide convenient drainage channels 16 for rain water. The drainange channels 16 each drain from the sides of the sun lounge towards its centre, there being a drainage hole (too small to be illustrated) located in each channel 16 and aligned with the longitudinal axis of the lounge.

Furthermore, as seen in FIGS. 1 and 5, in particular, the rear legs 4, 5 are provided with rollers or wheels 19. Thus the sun lounge can be held and raised by its front legs 2, 3 and wheeled from one location to another in the manner of a wheelbarrow. This facility is made all the more easy if the sun lounge is moulded from polypropylene which, in addition to being weather resistant, is also light in weight without sacrificing strength.

The sun lounge of the preferred embodiment is moulded in four separate parts (seat portion 1, two struts 8, 9 and back rest 6) thereby permitting transportation to its destination in a knockdown condition. In order to assemble the sun lounge the following procedure is carried out.

First the seat portion is positioned on the floor in the position illustrated in the drawings. Then the struts 8, 9 are engaged with the pins 31 (FIG. 7) on the back rest 6 by passing the bosses 36 through the grooves 37 and then rotating the struts 8, 9 relative to the back rest 6.

To continue the assembly procedure, each strut 8, 9 is held in a generally vertical position whilst the ends 20, 21 are passed through transverse slots 24 and engaged with longitudinal slots 25. Next with the back rest 6 in a generally horizontal position, the protrusion 18 is snap engaged with the trough 17 on the seat portion 1. This inter-connects the back rest 6 and seat portion 1.

The foregoing described only one embodiment of the present invention and modifications, obvious to those skilled in the art, may be made thereto without departing from the scope of the present invention.

What I claim is:

1. A reclining chair assembled from only four major moulded plastic component parts which comprise a seat portion, a back portion and two struts with each of said parts being substantially integrally formed, wherein said seat portion is generally horizontal and includes a pair of front legs and a pair of rear legs; said back portion is pivotally connected at its lower end to said seat portion and movable between a substantially upright position and at least one inclined position; and said two struts are spaced apart by, and pivotally connected to, said back portion at a location spaced from the pivotal connection between said back and seat portions; the point of contact of each of said struts with the corresponding rear leg being adjustable to determine the degree of inclination of said back portion, and each said strut extending forwardly beyond said back portion to form a corresponding arm rest having an attitude adjustable simultaneously with the inclination of said back portion; wherein each rear leg has an upwardly opening channel of substantially C-shaped transverse cross-section; each channel having a transverse slot therein the length of which is greater than the width of the remainder of said channel, and having a plurality of grooved steps located interior of the channel, and wherein the rear end of each said strut is provided with a transverse projection having a length less than both the length of said slot and the internal width of said channel but greater than the width of the opening of said remainder of said channel whereby each said strut is engageable with, said disengageable from, the corresponding channel only by passing the corresponding projection through the corresponding slot and the adjustable point of contact of each said strut with the corresponding rear leg comprises the point of engagement between each said strut rear end and one of the grooved steps in the corresponding channel.

2. A chair as claimed in claim 1, wherein in one of said inclined positions of said back portion, said back portion is substantially aligned with the seat portion to permit said chair to function as a couch or bed.

3. A chair as claimed in claim 2 which when moved into said one inclined position, is able to be stacked with a like chair which has also been moved into said inclined position.

4. A chair as claimed in claim 1, wherein the back portion of the strut means are releasable from the remainder of the chair.

5. A chair as claimed in claim 1, wherein said pivotal connection between said back portion and seat portion comprises a trough on one of said back portion or said seat portion and an elongate protrusion on the other one of said portions, said protrusion being engaged with said trough.

6. A chair as claimed in claim 5, wherein said trough has a substantially C-shaped transverse cross-section and said elongate protrusion has a substantially part circular transverse cross-section.

7. A chair as claimed in claim 1, wherein the pivotal connections between each struts and said back portion each comprises a pin on one of either the corresponding strut or said back portion, said pin being engageable with, and rotatable in, a corresponding aperture in the other one of either said corresponding strut or said back portion.

8. A chair as claimed in claim 7, wherein said aperture is substantially circular, said pin includes one or more bosses each extending transversely from said pin beyond the diameter of said aperture, and said aperture includes one or more grooves each corresponding to one of said bosses, wherein said corresponding strut is movable relative to said back portion to align said groove(s) and boss(es), said pin is insertable within said aperture by moving each boss along and past the corresponding groove, and said corresponding strut is movable with said pin rotatably engaged in said aperture to mis-align said boss(es) and groove(s) thereby preventing said pin being withdrawn from said aperture except when said boss(es) and groove(s) are aligned.

9. A chair as claimed in claim 1, wherein said seat portion extends forwardly to provide a generally horizontal support for the lower legs of a person sitting in the chair.

10. A chair as claimed in claim 1, wherein each of the rear legs of said chair is fitted with a roller means located adjacent the lower end of said each rear leg.

11. A chair as claimed in claim 10, wherein with all said legs supporting said chair at least a portion of the lower end of each said rear leg supports said chair, and wherein raising said front legs supports said chair only by said roller means thereby permitting said chair to be wheeled from one location to another via rotation of said roller means.

12. A chair as claimed in any one of claims 2 to 6, 8 to 11 and 1, wherein said seat portion and said back portion are provided with a plurality of transverse ribs which define transverse drainage channels.

* * * * *